US010098438B2

(12) United States Patent
Pires et al.

(10) Patent No.: US 10,098,438 B2
(45) Date of Patent: Oct. 16, 2018

(54) COSMETIC PACKAGE

(71) Applicant: ZEN DESIGN SOLUTIONS LIMITED, Kowloon (CN)

(72) Inventors: Leo Clifford Pires, Basking Ridge, NJ (US); Rajesh Deswal, Haryana (IN); Rahul Bose, New Delhi (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 110 days.

(21) Appl. No.: 15/376,158

(22) Filed: Dec. 12, 2016

(65) Prior Publication Data

US 2017/0172285 A1 Jun. 22, 2017

(30) Foreign Application Priority Data

Dec. 18, 2015 (IN) ..... 4153/DEL/2015

(51) Int. Cl.
*A45D 40/26* (2006.01)
*A46B 9/02* (2006.01)

(52) U.S. Cl.
CPC ..... *A45D 40/267* (2013.01); *A46B 9/021* (2013.01); *A45D 40/265* (2013.01); *A46B 2200/1053* (2013.01)

(58) Field of Classification Search
CPC .. A45D 34/043; A45D 34/046; A45D 34/045; A45D 40/264; A45D 40/265; A45D 40/267; A45D 2200/1053; A46B 7/02; A46B 9/021; A46B 5/0075
See application file for complete search history.

(56) References Cited

U.S. PATENT DOCUMENTS 3,998,235 A * 12/1976 Kingsford ..... A45D 34/00 132/218
4,446,880 A * 5/1984 Gueret ..... A45D 40/265 132/218
4,990,014 A * 2/1991 O'Neill ..... A45D 40/267 401/127
5,121,763 A * 6/1992 Kingsford ..... A45D 40/28 132/317
5,137,038 A * 8/1992 Kingsford ..... A45D 40/265 132/218
6,799,582 B2 * 10/2004 Kim ..... A45D 34/043 132/317

(Continued)

FOREIGN PATENT DOCUMENTS

WO WO-2007117091 A1 10/2007

*Primary Examiner* — Jennifer C Chiang
*Assistant Examiner* — Bradley Oliver
(74) *Attorney, Agent, or Firm* — Patterson + Sheridan, LLP

(57) ABSTRACT

The present disclosure generally relates to a cosmetic package which includes an application member that can be adjusted as per user's convenience for application of a cosmetic or a care product. The cosmetic package includes a dialer which assumes a locked configuration when an applicator is retained on a container and an unlocked configuration when the applicator is disengaged from the container. In the locked configuration, the dialer cannot be actuated to transform profile of an application member of the applicator. A locking member is provided in the package which slidably engages and disengages with the dialer to respectively lock and unlock the actuation of the dialer in respective the locked and the unlocked configuration.

20 Claims, 10 Drawing Sheets

(56) References Cited

U.S. PATENT DOCUMENTS

| | | | | |
|---|---|---|---|---|
| 8,944,713 | B2 * | 2/2015 | Koguchi | A45D 40/205<br>401/126 |
| 9,301,592 | B2 * | 4/2016 | Hofmann | A45D 40/265 |
| 2017/0311693 | A1 * | 11/2017 | Choi | A45D 34/04 |
| 2018/0055205 | A1 * | 3/2018 | Pires | A46B 7/02 |

* cited by examiner

COSMETIC PACKAGE

CROSS-REFERENCE TO RELATED APPLICATION

This application claims benefit of priority to Indian Provisional Application Ser. No. 4153/DEL/2015, filed on Dec. 18, 2015, which is incorporated by reference in its entirety.

BACKGROUND

Field of the Invention

The present disclosure generally relates to a cosmetic package for a product, in particular cosmetic or care product such as for example nail varnish, mascara or cream product. More particularly, the disclosure relates to a cosmetic package which includes an application member that can be adjusted as per user's convenience for applying the cosmetic or care products.

Description of the Related Art

Conventional cosmetic packages for applying cosmetic or care products include, a container containing a product, a cap intended for closing the container and a stem attached with the cap and wherein the stem supports an application member (or end-piece) capable of dispensing the product with a view to apply it in the desired place. Generally speaking, the application member is adapted to the product to be applied and may be a brush, a mascara brush or a specific application end-piece made from foam, plastic etc. The conventional cosmetic packages further also comprise a wiper comprising an elongated passage through which the stem and application member passes longitudinally on being withdrawn from the container. The wiper is supported by a neck of the container. The wiper serves firstly to wipe the stem and secondly to remove excess cosmetic from the application member.

The application member of most commercial cosmetic packages are fixed and permanently attached to the stem however, there have been some cosmetic packages shown in the prior art that have means for adjusting profile of application member. For example in U.S. Pat. No. 4,446,880 to Gueret & Arraudeau, and U.S. Pat. Nos. 3,998,235 and 5,137,038 to Kingsford, several makeup brushes are described where the profile of the brush section is adjustable by either changing their overall diameter, curvature or spacing between the bristles.

While International Patent application WO 2007/117091A1 to Amorepacific Corporation, discloses an adjustable mascara brush that includes a brush stick provided in a cap, a brush provided at the end of the brush stick and an elevating bar which is connected to the brush stick in a manner of screw wherein the brush gets straightened when the elevating bar is elevated down and the brush gets curved when the elevating bar is elevated up.

In each of the prior art patents disclosed, adjustments to the brush section can be made by adjusting the dialer of the cap, more specifically they include a rotatable cap. However, none of the prior art patents, provides means for protecting the dialer against accidental actuation or unintentional actuation by the user in the closed position of the cosmetic package. The actuation of the dialer/rotation of the cap in the closed position of the cosmetic package is undesirable as the accidental actuation causes the application member to deform in the storage position. The deformation of the application member, such as increase in diameter thereof or curving thereof may be undesirable because during withdrawal from the container it may cause damage to application member. Normally wipers employed in such cosmetic packages are designed to function effectively on non-deformed application member and therefore withdrawing of the deformed application member will not provide proper wiping to the application member and hence proper make up effect may not be achieved.

It would therefore be desirable to provide a cosmetic package, such as a mascara container of the general type described above, that mitigates or overcomes the aforementioned problems.

Accordingly it is desirable to provide a cosmetic package where a user can't actuate the dialer in the closed position of the cosmetic package.

SUMMARY

The present disclosure generally relates to a cosmetic package for a product, in particular cosmetic or care product such as for example nail varnish, mascara or cream product.

According to an embodiment of the present disclosure, there is provided a cosmetic package which includes an application member that can be adjusted as per user's convenience for application of a cosmetic or a care product. The cosmetic package can't be actuated by the user in a closed position of the cosmetic package.

In accordance with an embodiment of the disclosure, the cosmetic package includes a dialer which when rotated initiates a mechanism for transforming profile of an application member of the cosmetic package.

According to an embodiment of the disclosure, the dialer is capable of assuming a locked configuration and an unlocked configuration. In the locked configuration, the dialer cannot be actuated to transform the profile of the application member. Preferably, in the locked configuration, the dialer cannot be rotated to transform the profile of the application member. In the unlocked configuration, the dialer can be actuated to transform the profile of the application member. Preferably, in the unlocked configuration, the dialer can be rotated to transform the profile of the application member.

According to an embodiment of the disclosure, there is provided a locking member which engages and disengages with the dialer to respectively lock and unlock the rotation of the dialer in respective locked and unlocked configuration.

According to an embodiment of the disclosure, there is provided an inner rod which when lifted or lowered transforms the shape/profile of the application member by releasing and applying pressure on the application member.

According to an embodiment of the present disclosure, the applicator member includes a bore and an end of the inner rod is connected to a distal end of the application member and the other end of the inner rod is connected to an adjustment means. The adjustment means is actuated by rotation of the dialer for lifting and lowering the inner rod.

According to another embodiment of the present disclosure, the adjustment means is actuated by rotation of the dialer for rotating the inner rod to transform the shape/profile of the application member.

According to an embodiment of the disclosure, the cosmetic package includes an applicator and a container. The container and applicator are intended to be fastened to each other by screwing. The applicator may comprise a cap; an application member and a stem having a cavity. The stem may be connected to the application member at one end and to the cap at another end. The cap further comprises the dialer at the proximal end of the applicator, a sleeve connected to the dialer and the locking member inside the sleeve which is configured to be detachably connected to the dialer. The dialer could be connected to the inner rod in such a way that rotational movement of the inner rod with respect to the sleeve is restricted while translation movement is allowed. The stem housing the inner rod is non-rotatable with respect to the sleeve.

According to an embodiment of the disclosure, when the applicator is removed/disengaged from the container, the dialer assumes the unlocked configuration in which the dialer is rotatable with respect to the sleeve. In the unlocked configuration, a user is able to rotate the dialer, thereby the inner rod which is housed within the stem member is lifted or lowered for transforming the shape/profile of the application member. Alternatively, the inner rod may be rotated on rotation of the dialer for transforming the shape/profile of the application member.

When the applicator is retained on the container, the dialer takes up the locked configuration, in which the user is unable to rotate the dialer with respect to the sleeve; therefore the profile of the application member does not change when the cosmetic package is in closed position.

According to an embodiment of the present disclosure, the dialer is attached with the sleeve of the cap such that the dialer is free to rotate with respect to the sleeve. The dialer has a closed-end cylindrical shape which is provided with a tube portion having a small outer diameter, and an annular protruding portion is provided in an outer peripheral surface of the tube portion for attaching to the sleeve. The dialer is attached to the sleeve via a snap-fit system comprising the external annular protruding portion and a complementary annular groove of the sleeve. The dialer further includes an internal annular skirt having an inner profile, such as mating threads capable of interacting with an outer thread of the inner rod mounted axially inside dialer.

According to yet another embodiment of the present disclosure, the sleeve comprises two concentric cylinders joined together by linking ribs, i.e. a larger diameter outer cylinder is disposed around a hollow inner cylinder and the linking ribs are connected from the inner cylinder to the outer cylinder. According to a preferred embodiment, the linking ribs are radially disposed such that there are hollow spaces between the adjacent linking ribs. The outer cylinder comprises the internal annular groove for attaching to the external annular protruding portion of the dialer.

According to yet another embodiment of the present disclosure, for guiding axial movement of the inner rod and for preventing inner rod from rotating, when the dialer is twisted, there is provided longitudinal guide protrusions in interior surface of the inner cylinder of the cap. However in alternate embodiments, the longitudinal guide protrusions may be provided in stem member or both in stem member and inner cylinder of the cap.

According to yet another embodiment, the inner rod is rotatable by rotating the dialer.

According to yet another embodiment of the present disclosure, for engaging the stem to the sleeve, a portion of inner cylinder is inserted/received into an upper tubular portion of the stem and a groove at the outer surface of inner cylinder mates with complementary protrusion present on the inner surface of the upper tubular portion of the stem. However, in alternate embodiments, the stem may be received in the inner cylinder for the engagement. Further, for non-rotatably locking the stem and the sleeve together, on the interfaces where the stem is joined to the sleeve, the stem and the sleeve both have complementary longitudinal protrusions and positioning longitudinal grooves that engage with each other. However, it is not beyond the ambit of the present disclosure that any other non-rotatable engagement known in the art may be employed for locking any relative rotation between the stem and the sleeve.

According to yet another embodiment of the present disclosure, the stem comprises the upper tubular portion, a downward skirt, a joint defined between the upper tubular portion and the downward skirt, and an elongated hollow shaft. An inner thread is provided on the inner peripheral surface of the downward skirt of the stem which is adapted to attach the cap to an externally threaded neck of the container. With the cap so attached, the application member is immersed in product to be applied. The elongated hollow shaft extends beyond the neck in the container. Preferably, the shaft of the stem member is disposed around at least a portion of the inner rod that is longitudinally movable with respect to shaft. Alternately, the inner rod is rotatable with respect to the shaft. The shaft and the inner rod may have circular transverse cross-sections or non-circular transverse cross-sections.

According to yet another embodiment of the present disclosure, the cap further includes such features that allow an axial movement of the inner rod but rotation of the inner rod is prevented when the dialer is rotated with respect to the sleeve. For example, the inner rod includes two annular flanges having two opposing slide cut-outs for receiving the longitudinal guide protrusions of the sleeve which prevent rotation of the inner rod. Further, one or more annular ribs and sealing O-rings are configured around the inner rod so that the inner rod interfaces tightly against an inner wall of the shaft The annular ribs and the sealing O-rings prevent the product P from leaking and ensure steady, smooth, and noiseless extension of the inner rod along the shaft.

According to yet another embodiment of the present disclosure, regardless of the particular application member chosen, the present disclosure provides means adapted to selectively vary the profile of the application member. In unlocked configuration of the cosmetic package, when the dialer is rotated with respect to the cap, the shaft and the inner rod move longitudinally or rotate with respect to each other which cause variation in the profile of the application member. When a suitable adjustment of the profile of the application member has been made it will be retained while the application member is used. The adjustment is retained until the user intentionally rotates the dialer and sleeve with respect to each other once again to achieve a different adjustment.

According to yet another embodiment of the present disclosure, to prevent the dialer from rotating with respect to the sleeve in the locked configuration, there is provided in the cap, the locking member. The locking member has a barrel body having teeth at its first end and an annular shoulder defined at outer periphery of the barrel body. The locking member is slidably mounted in a space defined between the sleeve and the stem. In the locked configuration, the teeth of the barrel body engage with complementary teeth of the dialer. The locking member further includes longitudinal cut outs on the barrel body, the longitudinal cut outs open at the peripheral edge of the barrel body having teeth.

According to yet another embodiment of the present disclosure, there is provided a spring that surrounds a portion of locking member above the shoulder of the barrel body such that one end of the spring abuts linking ribs of the sleeve and its other end abuts the shoulder of the locking member and wherein spring urges the locking member away from the dialer.

According to yet another embodiment of the present disclosure, the longitudinal cut outs are provided on the locking member so that the top part of the locking member may slide through hollow spaces between the linking ribs of the sleeve to engage with the dialer for non-rotatably engaging the locking member with the sleeve.

According to yet another embodiment of the present disclosure, when the applicator is screwed on the container, the container shoulder abuts the distal end of the locking member and exerts an upward sliding force upon the locking member pushing it upward against the downward biasing force of the spring thereby compressing the spring and engaging the teeth of the locking member with the complementary teeth of the dialer. In the closed position of the package, the dialer, the sleeve, and the stem member and the locking member are engaged in non-rotatable manner with respect to one other. Therefore, the dialer can't be rotated independently of the sleeve i.e. when the dialer is rotated the sleeve also rotates simultaneously as the locking member engages dialer to the sleeve in a non-rotatable engagement. Moreover, the sleeve is also non-rotatably engaged to the stem and therefore, it causes rotation of the cap in whole and rotation thus leads to unscrewing of the cap from the container without causing actuation of the adjusting means.

According to yet another embodiment of the present disclosure, once the cap is unscrewed, the locking member is pushed downward due to biasing/restoring force of the spring and the locking member slides downwards disengaging itself from the dialer. The dialer thus becomes free to rotate with respect to sleeve. Now to transform the profile of the application member, the dialer is twisted and the rotational movement is converted into translational movement of the inner rod by the rotational movement of threads within the inner skirt of the dialer. Therefore, the inner rod is now able to extend or retract toward/away the distal end of the shaft. As the inner rod is extended or retracted, the profile of application member changes due to pressure applied on it the by axial movement of the inner rod. The inner rod can be adjusted to various relative longitudinal positions with respect to the shaft depending on degree of twisting, such that as adjustment is made, profile of the application member varies. Once the adjustment is made, it will be retained without any action by the user, until further adjustment is desired and intentionally made. Alternately, to transform the profile of the application member, the dialer is twisted and the rotational movement is converted into translational movement and/or rotational movement of the inner rod by the rotational movement of threads within the inner skirt of the dialer.

According to yet another embodiment of the present disclosure, to avoid the inner rod from being moved completely out of the internal threads of the dialer when the dialer is rotated, there is provided a projecting stop on inner surface of outer cylinder which prevents the complete or over-rotation of the dialer i.e. the dialer cannot be rotated to 360 degree or more with respect to the sleeve in one particular direction and therefore doesn't run out of length of the internal threads of the dialer.

According to yet another embodiment of the present disclosure, the threads of the dialer and threads screwing the gripping member to container are preferably threads in opposite directions.

According to yet another embodiment of the present disclosure, there is provided a wiper to wipe excess product from the applicator as the applicator is withdrawn from the container.

According to yet another embodiment of the present disclosure, the materials suitable for forming the container could be polypropylene while the dialer, the cap, the inner rod, the stem member, and locking member could be formed of acrylonitrile butadiene styrene, PP, TPE or any other suitable polymeric material. The material of inner rod could be any polymeric material as nylon, PP, TPE or could be a suitable metal. The stem 40 may be formed of polyacetal or any other suitable polymeric material. The material for forming wiper could be low-density polyethylene. The aforementioned materials for forming various parts of the cosmetic package of the present disclosure are an example, however other suitable materials may also be used.

According to yet another embodiment of the present disclosure, depending upon the substance being used in the container, a variety of sizes and shapes of the application member can be utilized. The application member may be constructed of a porous or non-porous rubber, fabric mesh, felt material, foamed polymers, sponge material, Hytrel™ TPE or any other suitable material. Also, the application member could have any suitable shape depending on the kind of application required. It could have a shape other than cylindrical such as ovular, tapered or any other suitable shape. The application member may be chosen according to the cosmetic or care product to be applied, be it lipstick, eye liner, eye shadow, mascara, foundation, blusher, care product etc.

Although the above description and drawings show the package being cylindrical, the shapes and profile cross section thereof are not limited to the same.

While the foregoing is directed to embodiments of the present disclosure, other and further embodiments of the disclosure may be devised without departing from the basic scope thereof, and the scope thereof is determined by the claims that follow.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
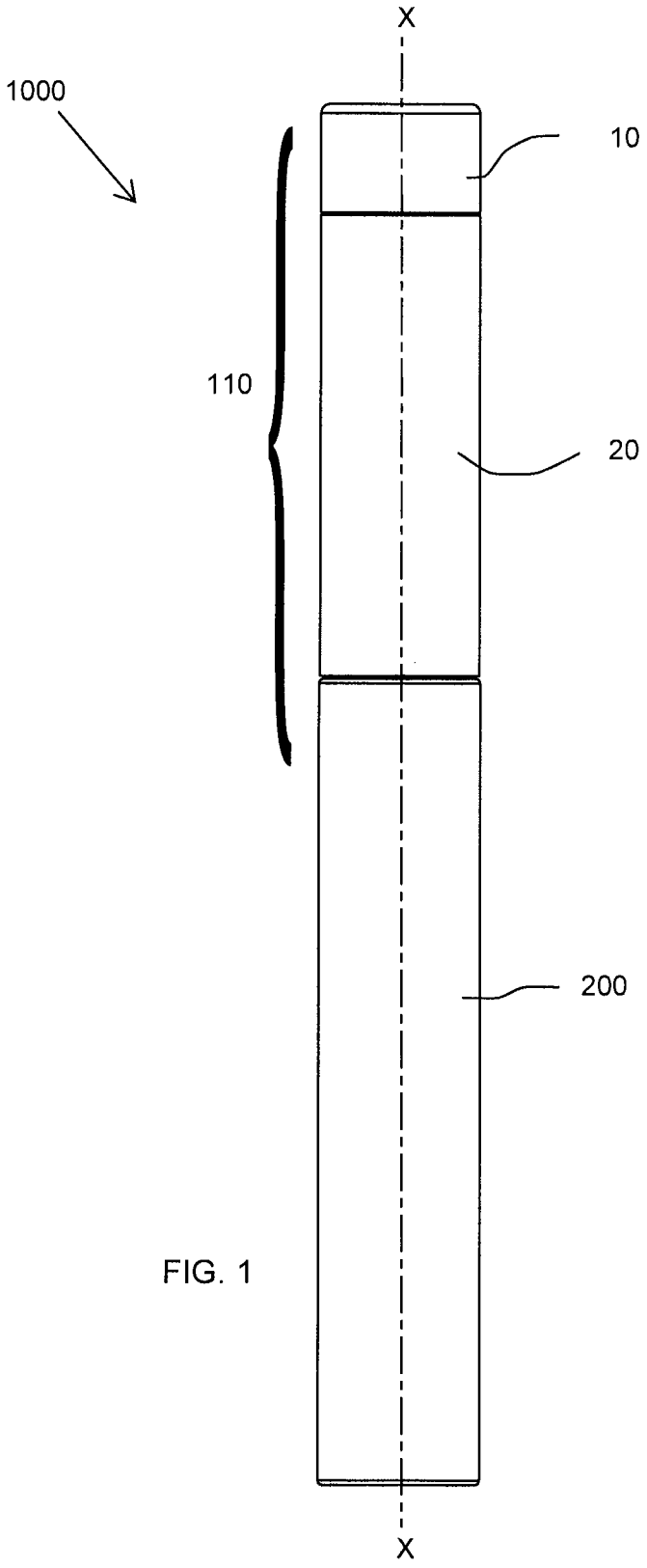
FIG. 1 illustrates a front view of a cosmetic package in closed position according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
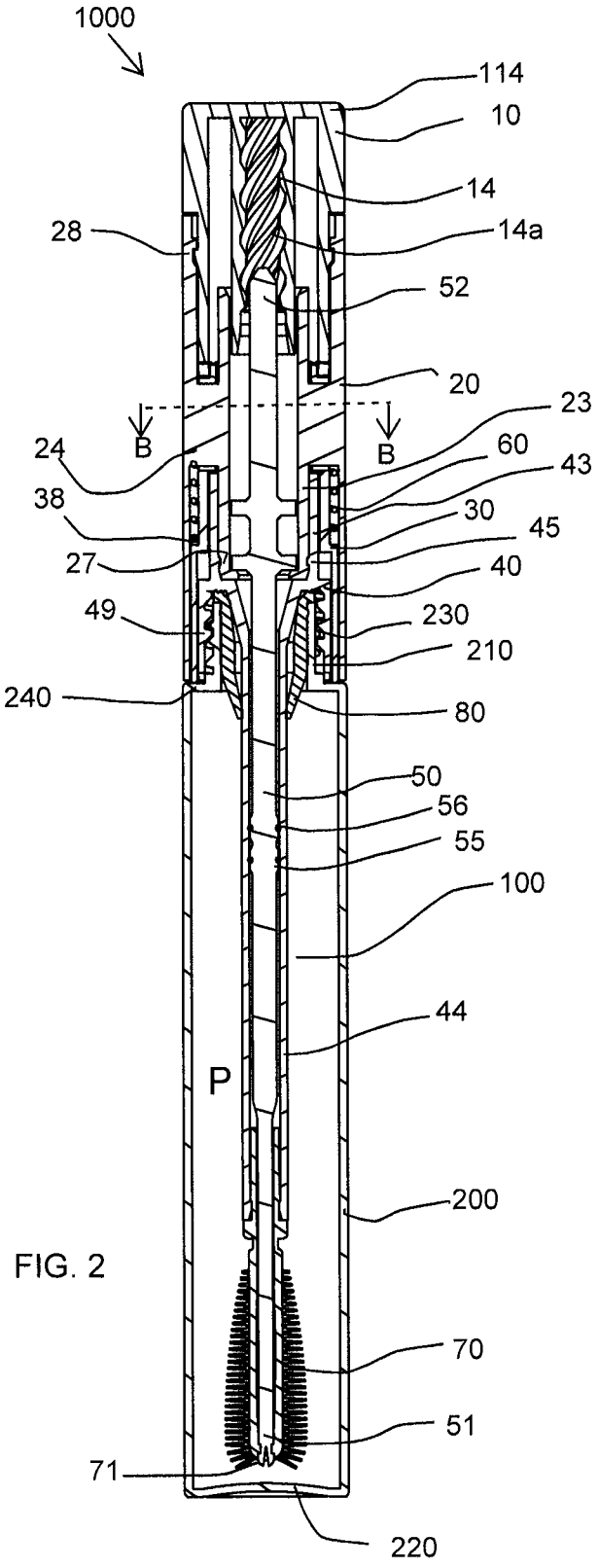
FIG. 2 illustrates a cross sectional view of the cosmetic package of FIG. 1 according to an embodiment of the present disclosure.

FIGS. 1 and 2 show a cosmetic package 1000 in accordance with the present disclosure, in a closed position. The cosmetic package 1000 includes an application member 70 which can be adjusted as per user's convenience for application of a product including a cosmetic or a care product. The cosmetic package 1000 having a longitudinal axis X-X, comprises an applicator 100 and a container 200. The container 200 and the applicator 100 are intended to be fastened to each other by screwing. The container 200 includes a neck 210 extending along the longitudinal axis X-X, a shoulder 240 and an end wall 220 forming a reservoir for a product P. The applicator 100 includes a cap 110 suitable for closing the container 200; the application member 70 and a stem 40 having a cavity 48 (see FIG. 9). The stem 40 may be connected to the application member 70 at one end and to the cap 110 at another end. The application member 70 is secured to the stem 40 and intended for being inserted in said container 200 in order to be loaded with the product P to be applied.

The neck 210 of the container 200 is provided with an external thread 230 intended for cooperating with a complementary thread 49 carried by the stem 40, allowing the container 200 to be closed by screwing.

For some cosmetic products, such as mascara or a lip gloss, it is preferable to provide a wiper 80 positioned into the neck 210 of the container 200 to wipe excess product P from the applicator 100 as the applicator 100 is withdrawn from the container 200. Wiper 80 is preferably made of an elastomeric plastic material.

As shown in FIGS. 1 and 2, the cap 110 comprises an upper portion comprising a dialer 10 and a lower portion comprising a sleeve 20 connected to the dialer 10. A locking member 30 is housed within the sleeve 20 and is configured to be detachably connected to the dialer 10. The stem 40 is non-rotatable with respect to the sleeve 20.

According to an embodiment of the present disclosure, the dialer 10 is capable of assuming a locked configuration and an unlocked configuration. When the applicator 100 is removed/disengaged from the container 200, the dialer 10 assumes the unlocked configuration in which the dialer 10 can be actuated, in this embodiment can be rotated with respect to the sleeve 20 of the cap 110. In the unlocked configuration, a user is able to rotate the dialer 10, thereby an inner rod 50 is lifted or lowered for transforming the shape/profile of the application member 70. According to an alternate embodiment, the inner rod 50 can be rotated by rotating the dialer 10 for transforming the shape/profile of the application member 70. Referring to FIG. 2, the inner rod 50 has a first end 51 and a second end 52. Attached to the first end 51 is the application member 70, such as a mascara brush and the second end 52 is attached to the dialer 10. The application member 70 may be chosen according to the cosmetic or care product to be applied, be it lipstick, eye liner, eye shadow, mascara, foundation, blusher, ointment etc. When the applicator 100 is retained on the container 200, the dialer 10 takes up the locked configuration, in which the user is unable to actuate, in this embodiment, unable to rotate the dialer 10 with respect to the sleeve 20 of the cap 110, therefore the profile of the application member 70 does not change when the cosmetic package 1000 is in closed position. The locking and unlocking mechanism of dialer 10 along with the other details of the cosmetic package 1000 will be explained fully hereinafter.

As shown in FIGS. 2-4B, the dialer 10 is structured in a closed-end cylindrical shape which is provided with a tube portion 16 having a small outer diameter, and an annular protruding portion 16*b* is provided on an outer peripheral surface of the tube portion 16 for attaching dialer 10 to the cap 20. The cap 20 is attached with the dialer 10 such that the cap 20 is free to rotate relative to the dialer 10 via a snap-fit system comprising the external annular protruding portion 16 *b* and a complementary annular groove 28 of the cap 20. The dialer 10 can thus be turned by the user relative to the cap 20. The dialer 10 further includes an internal annular skirt 14 projecting from an inner surface of a top wall of the dialer 10 and the internal annular skirt 14 extends towards the container 200. Preferably, the internal annular skirt 14 is coaxial with the tube portion 16. The inner surface of the internal annular skirt 14 includes an inner profile, such as mating threads 14*a* capable of interacting with an outer thread 53 of the inner rod 50 mounted axially inside the dialer 10.

Figure 4A:
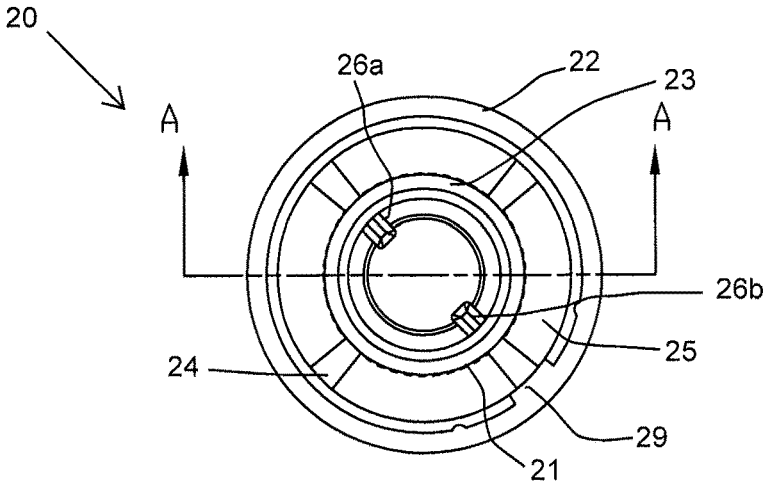
FIG. 4A illustrates a top view of lower portion/sleeve of cap of the cosmetic package of FIG. 1.
Figure 4B:
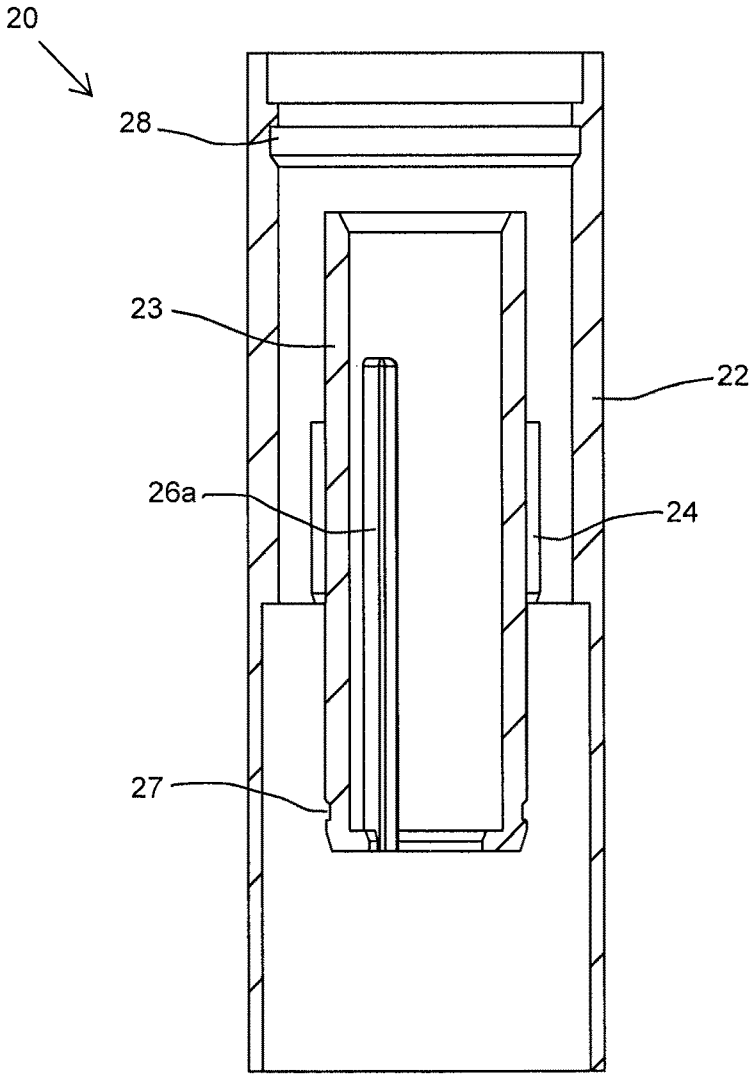
FIG. 4B illustrates a sectional view of lower portion/sleeve of the cap of FIG. 4A taken along an axis A-A.

As shown in FIGS. 4A and 4B, the sleeve 20 of the cap 110 comprises two concentric cylinders 22, 23 joined together by linking ribs 24, i.e. a larger diameter outer cylinder 22 is disposed around a hollow inner cylinder 23 and the linking ribs 24 connect an outer surface of the inner cylinder 23 to inner surface of the outer cylinder 22. According to a preferred embodiment, the linking ribs 24 are radially disposed such that there are hollow spaces 25 between the adjacent linking ribs 24. In the embodiment shown, there are four linking ribs 24 disposed radially. The outer cylinder 22 further comprises an internal annular groove 28 for attaching to an external annular protruding portion 16 *b* of the dialer 10. The inner cylinder 23 includes longitudinal guide protrusions 26*a* and 26*b* at its inner surface for guiding axial movement of the inner rod 50 and for preventing inner rod 50 from rotating, when the dialer 10 is twisted. According to an alternate embodiment, the inner rod 50 can be rotated by rotating the dialer 10 for transforming the shape/profile of the application member 70.

Figure 6:
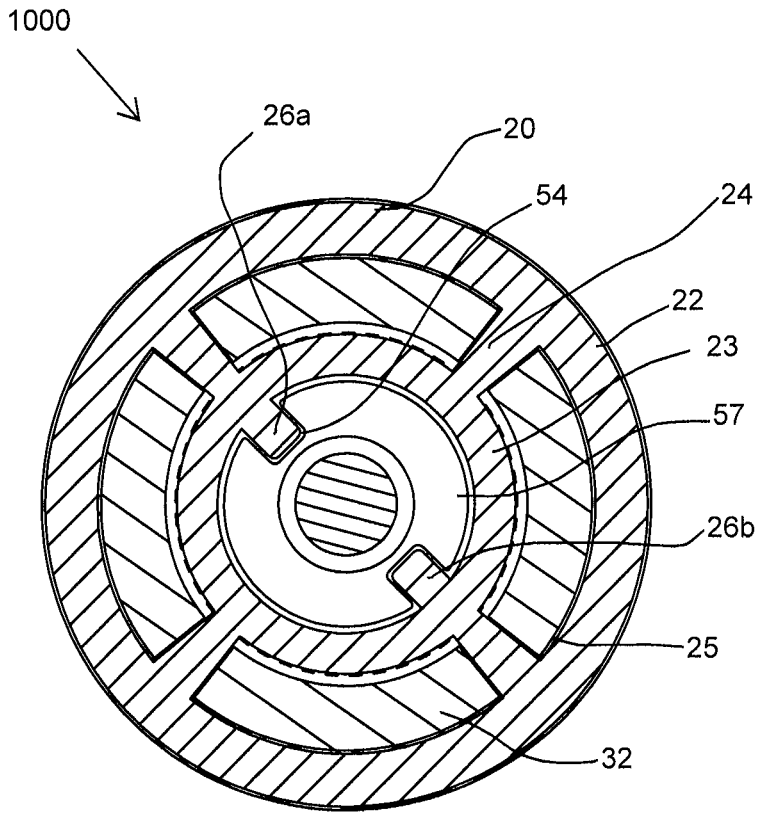
FIG. 6 illustrates a cross section of the cosmetic package of FIG. 2 taken along an axis B-B.

As seen in FIGS. 2 and 6, for engaging the stem 40 to sleeve 20 of the cap 110, a portion of inner cylinder 23 is inserted/received into an upper tubular portion 43 of the stem 40 and the outer surface of inner cylinder 23 have a groove 27 for engaging complementary protrusion 45 present on the inner surface of the upper tubular portion 43 of the stem 40. On the interfaces where the stem 40 is joined to the sleeve 20 of the cap 110, the stem 40 and the sleeve 20 of the cap 110 both have complementary longitudinal protrusions and positioning longitudinal grooves that engage with each other for non-rotatably locking the stem 40 and the sleeve 20 together. For, example as seen in FIG. 4A, the outer surface of inner cylinder 23 of the sleeve 20 includes a plurality of longitudinal protrusions 21 which is arranged to become in mating engagement with complementary grooves 41 (see FIG. 9) at an inner surface of the stem 40 or vice versa, for non-rotatable engagement. However, it is not beyond the ambit of the present disclosure that any other non-rotatable engagement known in the art may be employed for locking any relative rotation between the stem 40 and the cap 20.

Figure 3:
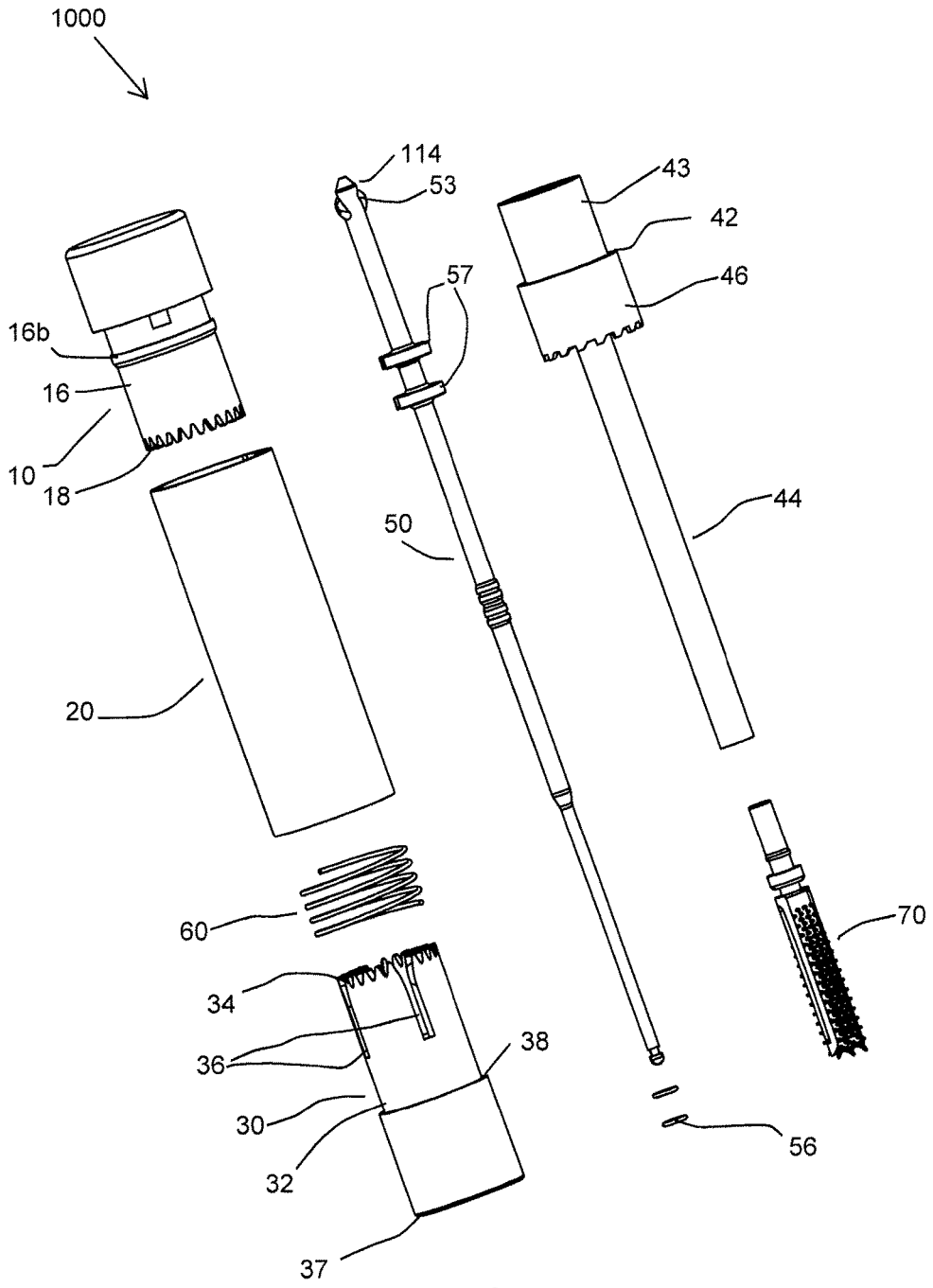
FIG. 3 illustrates an exploded view of an applicator of the cosmetic package of FIG. 1.
Figure 9:
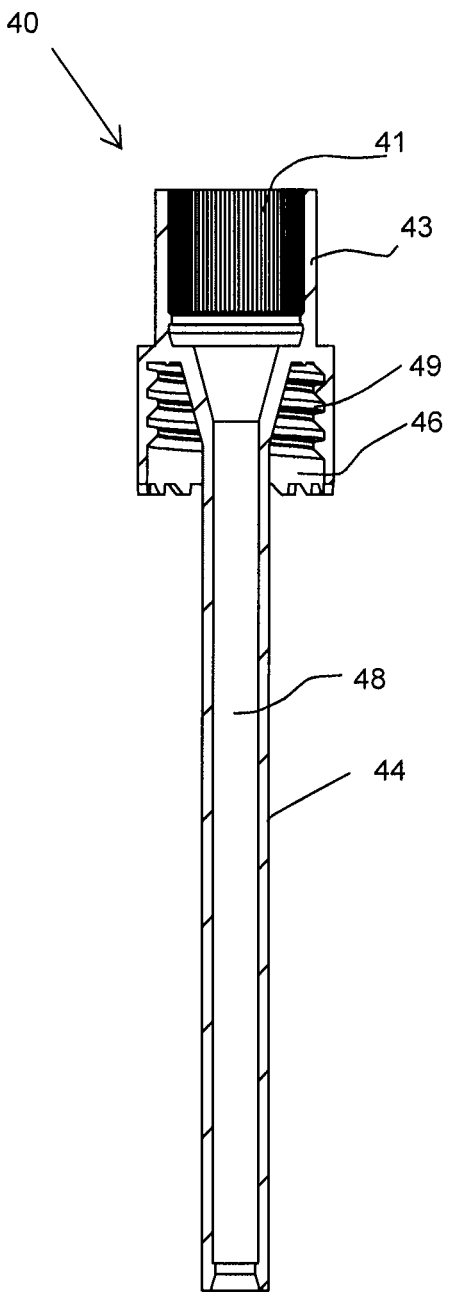
FIG. 9 illustrates a sectional view of a stem of the cosmetic package of FIG. 2.
Figure 12:
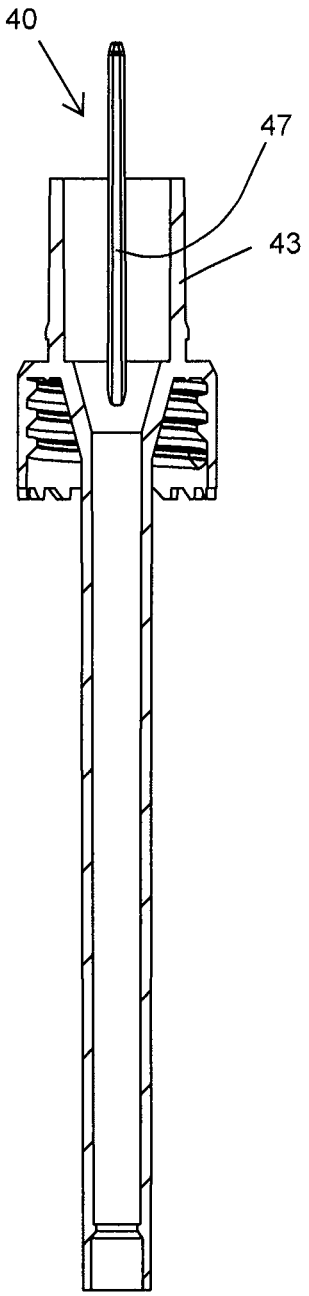
FIG. 12 illustrates a sectional view of a stem of the cosmetic package of FIG. 10.

Further, as seen in FIGS. 2, 3 and 9, the stem 40 comprises the upper tubular portion 43, a downward skirt 46, a joint 42 defined between the upper tubular portion 43 and the downward skirt 46, and an elongated hollow shaft 44. The threads 49 are provided on the inner peripheral surface of the downward skirt 46 of the stem 40 (see FIGS. 1& 9) to attach the cap 110 to an externally threaded neck 210 of the container 200. With the cap 110 so attached, the application member 70 is immersed in the product P to be applied. The elongated hollow shaft 44 extends beyond the neck 210 in the container 200. Preferably the elongated hollow shaft 44 of the stem 40 is disposed around at least a portion of the inner rod 50 that is longitudinally movable with respect to the shaft 44. According to another embodiment, the inner rod 50 is rotatable with respect to the shaft 44. In the embodiment illustrated, the shaft 44 and the inner rod 50 have circular transverse cross-sections. In other embodiments, the shaft 44 and the inner rod 50 may have non-circular transverse cross-sections.

Figure 5A:
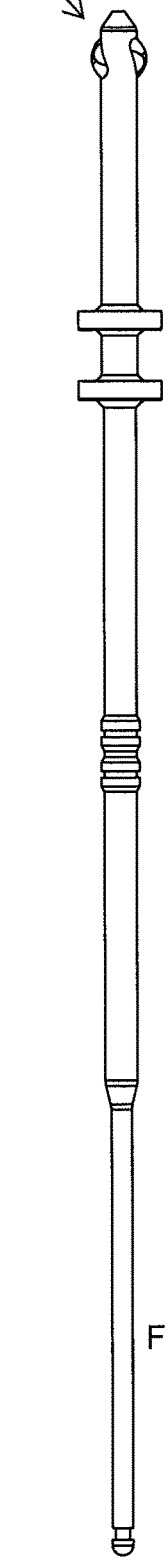
FIG. 5A illustrates a front view of an inner rod of the cosmetic package of FIG. 2.
Figure 5B:
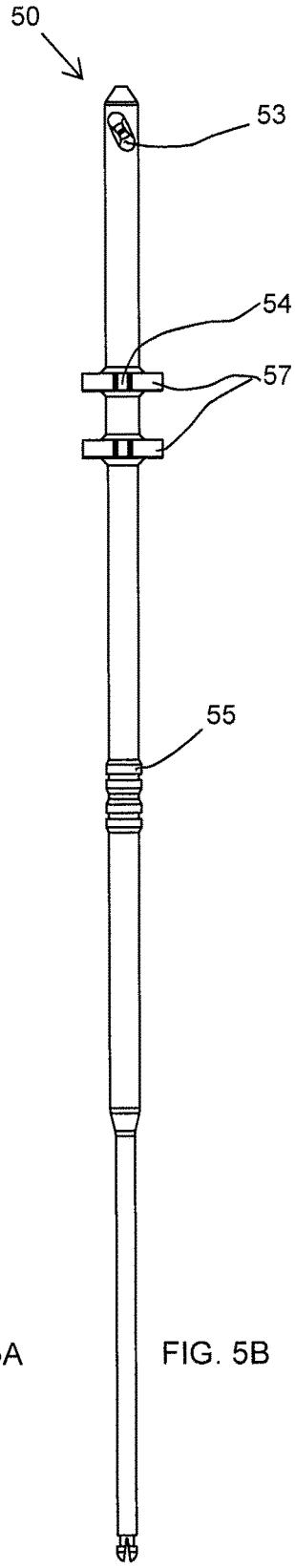
FIG. 5B illustrates a side view of the inner rod of FIG. 5A.
Figure 5C:
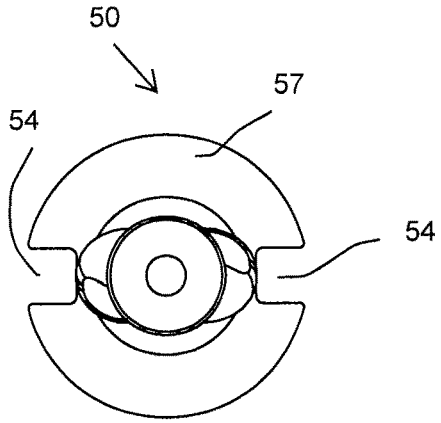
FIG. 5C illustrates an enlarged top view of the inner rod of FIG. 5A.

In the embodiment, the cap 110 further includes such features that allow an axial movement of the inner rod 50 but rotation of the inner rod 50 is prevented when the dialer 10 is rotated with respect to the sleeve 20. For example, as seen in FIGS. 5A-6, the inner rod 50 includes outer thread 53 at its upper part, two annular flanges 57 having two opposing slide cut-outs 54 for receiving the longitudinal guide protrusions 26*a* and 26*b* of the sleeve 20. Further, one or more annular ribs 55 and sealing O-rings 56 are configured around the inner rod 50 so that the inner rod 50 interfaces tightly against an inner wall of the shaft 44 (see FIG. 2). The annular ribs 55 and the sealing O-rings 56 prevent the product P from leaking and ensure steady, smooth, and noiseless extension of the inner rod 50 along the shaft 44.

Regardless of the particular application member 70 chosen, the present disclosure provides means adapted to selectively vary the profile of the application member 70. In unlocked configuration of the cosmetic package 1000, when the dialer 10 is rotated with respect to the sleeve 20, the shaft 44 and the inner rod 50 move longitudinally with respect to each other which cause variation in the profile of the application member 70. When a suitable adjustment of the profile of the application member 70 has been made it will be retained while the application member 70 is used. The adjustment is retained until the user intentionally rotates the dialer 10 and sleeve 20 with respect to each other once again to achieve a different adjustment. According to an alternate embodiment, the inner rod 50 is rotatable with respect to the shaft 44 to cause variation in the profile of the application member 70.

So that the dialer is prevented from rotating with respect to the sleeve 20 in the locked configuration, there is provided in the cap 110, the locking member 30. The locking member 30 engages and disengages with the dialer 10 to respectively lock and unlock the rotation of the dialer 10 with respect to sleeve 20 in respective locked and unlocked configuration. As shown in the FIG. 3, the locking member 30 has a barrel body 32 having teeth 34 at its first end and an annular shoulder 38 defined at its outer periphery. The barrel body 32 is slidably mounted in a space defined between sleeve 20 and the stem member 40 (see FIG. 2). The teeth 34 are present on a top peripheral edge of the barrel body 32 for engagement with complementary teeth 18 of the dialer 10. The locking member 30 further includes longitudinal cut outs 36 on the barrel body 32, the longitudinal cut outs 36 open at the top peripheral edge of the barrel body 32 having teeth 34. Referring to FIGS. 3 and 6, the longitudinal cut outs 36 are provided so that the top part of the barrel body 32 is able to slide into hollow spaces 25 present between the linking ribs 24 of the sleeve 20 for engaging with the dialer 10 and thereby also non-rotatably engaging the locking member 30 with the sleeve 20. There is provided a spring 60 that surrounds a portion of barrel body 32 above the shoulder 38 such that one end of the spring abuts linking ribs 24 and its other end abuts the shoulder 38 and wherein spring 60 urges the barrel body 32 in a direction away from the dialer 10.

Figure 7:
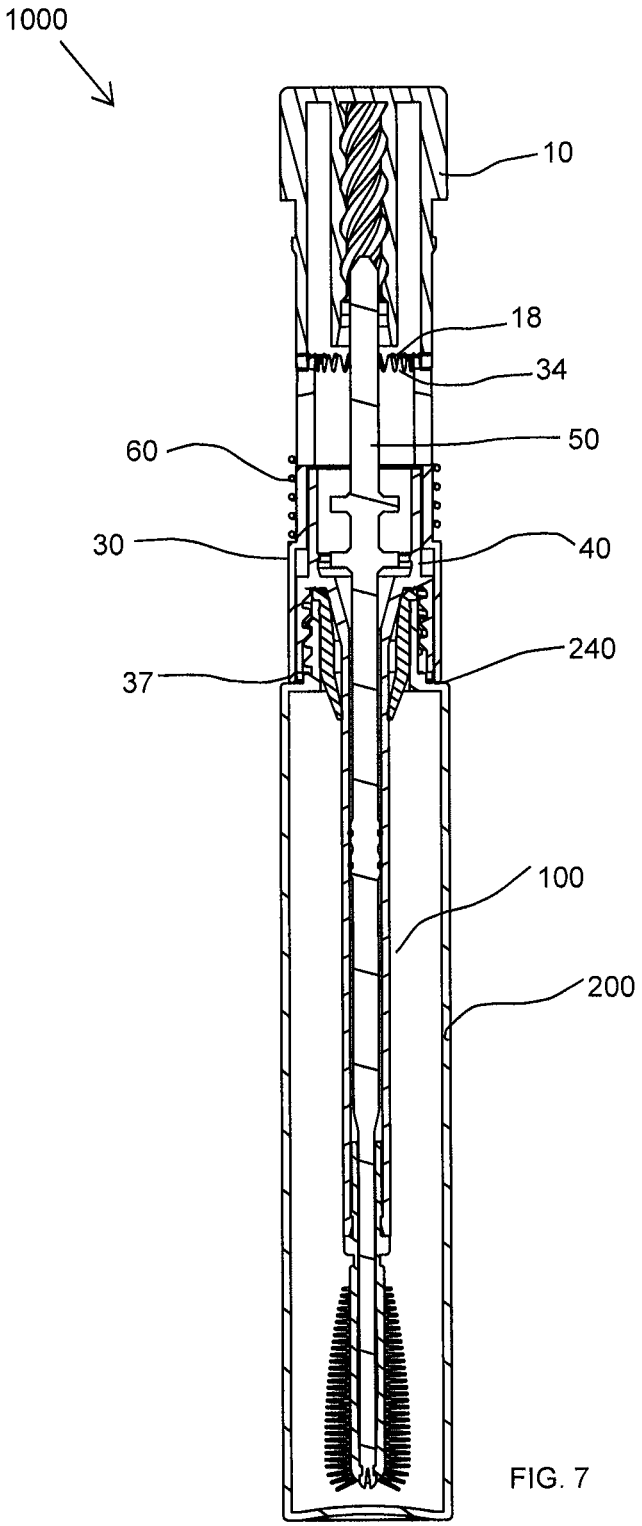
FIG. 7 illustrates a cross sectional view of the cosmetic package of FIG. 1 with the lower portion of the cap/sleeve hidden.

Referring to FIGS. 7 and 2, when the applicator 100 is screwed on the container 200, the container shoulder 240 abuts the distal end 37 of the locking member 30 and exerts an upward sliding force upon the locking member 30 pushing it upward against the downward biasing force of the spring 60 thereby compressing the spring 60 and engaging the teeth 34 of the locking member 40 with the complementary teeth 18 of the dialer 10. In the closed position of the cosmetic package 1000, the dialer 10, the sleeve 20, the stem 40 and the locking member 30 are engaged in non-rotatable manner with respect to one other. Therefore, the dialer 10 can't be rotated independently of the sleeve 20 i.e. when the dialer 10 is rotated the sleeve 20 also rotates simultaneously as the locking member 30 engages the dialer 10 to sleeve 20 in a non-rotatable engagement. Moreover, the sleeve 20 is also non-rotatably engaged to the stem 40 and therefore, it causes rotation of the cap 110 in whole and rotation thus leads to unscrewing of the cap 110 from the container 200 without causing actuation of the adjusting means/the inner rod 50.

Figure 8A:
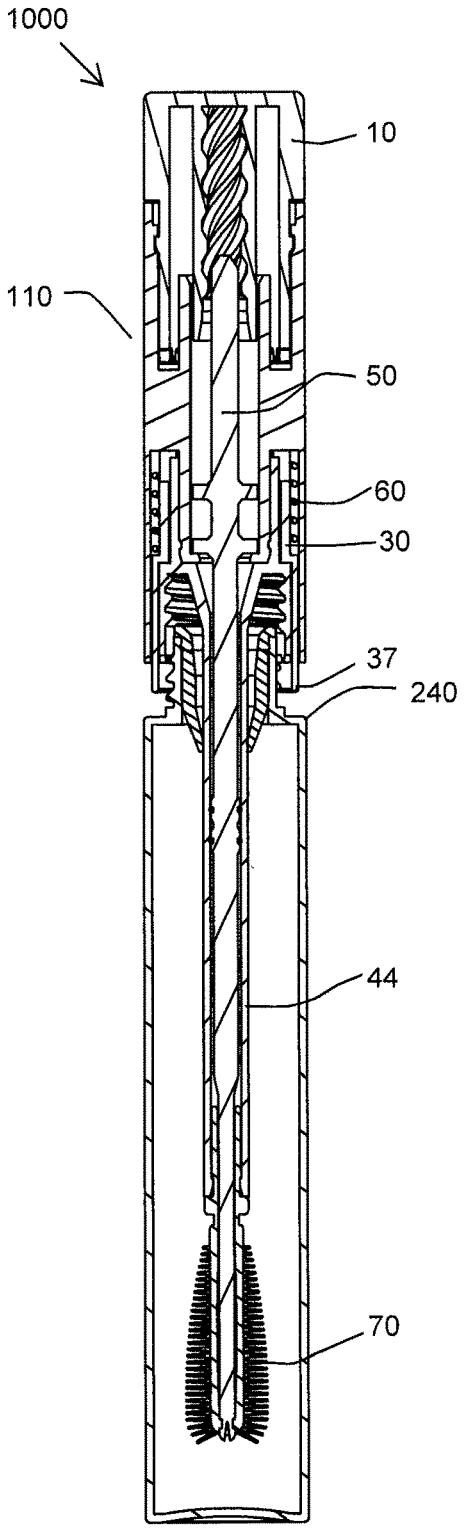
FIG. 8A illustrates a cross sectional view of the cosmetic package of FIG. 1 in an open position.
Figure 8B:
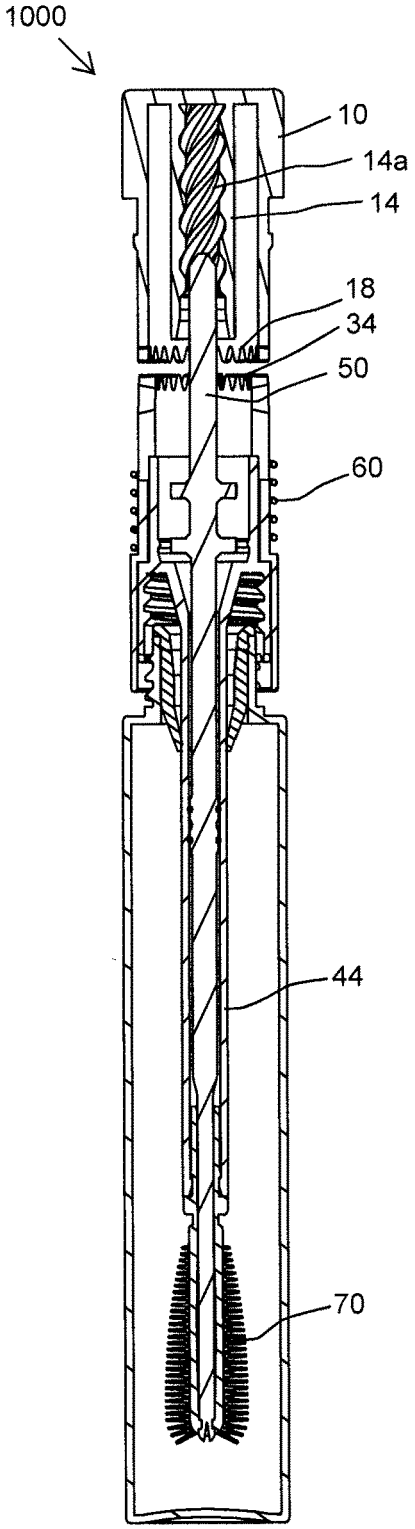
FIG. 8B illustrates a cross sectional view of the cosmetic package of FIG. 1 in an open position with the lower portion of the cap/sleeve hidden.

Referring now to FIGS. 8A and 8B, once the cap 110 is unscrewed, the locking member 30 is pushed downward due to biasing/restoring force of the spring 60 and the locking member 30 slides downwards disengaging itself from the dialer 10 and thereby disengaging the teeth 34 and the teeth 18 of the dialer 10. The dialer 10 thus becomes free to rotate with respect to sleeve 20. Now to transform the profile of the application member 70, the dialer 10 is twisted and the rotational movement of the dialer 10 is converted into translational movement of the inner rod 20 by the rotational movement of threads 14*a* within the inner skirt 14 of the dialer 10. Therefore, the inner rod 50 is now able to extend or retract towards or away from the distal end of the shaft 44. As the inner rod 50 is extended or retracted, the profile of application member 70 changes due to pressure applied on it by the axial movement of the inner rod 50. The inner rod 50 can be adjusted to various relative longitudinal positions with respect to the shaft 44 depending on degree of twisting, such that as adjustment is made, profile of the application member 70 varies. Once the adjustment is made, it will be retained without any action by the user, until further adjustment is desired and intentionally made.

According to present embodiment, to avoid the inner rod 50 from being moved completely out of the internal threads 14*a* of the dialer 10 when the dialer 10 is rotated, there is provided a projecting stop 29 (See FIG. 4A) on inner surface of outer cylinder 22 which prevents the complete or over-rotation of the dialer 10 i.e. the dialer 10 cannot be rotated to 360 degree or more with respect to the sleeve 20 in one particular direction and therefore doesn't run out of length of the internal threads 14*a* of the dialer 10. According to present embodiment, the threads 14*a* of the dialer 10 and threads 49 of the applicator 100 are preferably threads in opposite directions.

Figure 10:
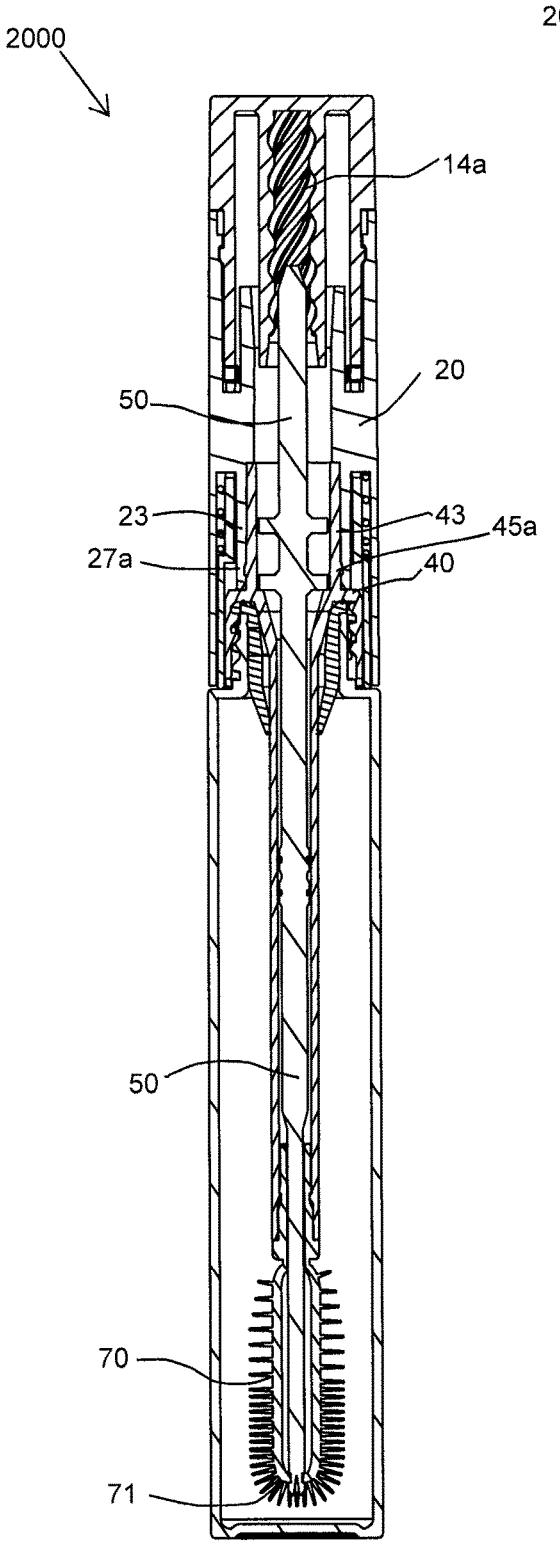
FIG. 10 illustrates a cross-sectional view of a cosmetic package according to a second embodiment of the present disclosure.
Figure 11:
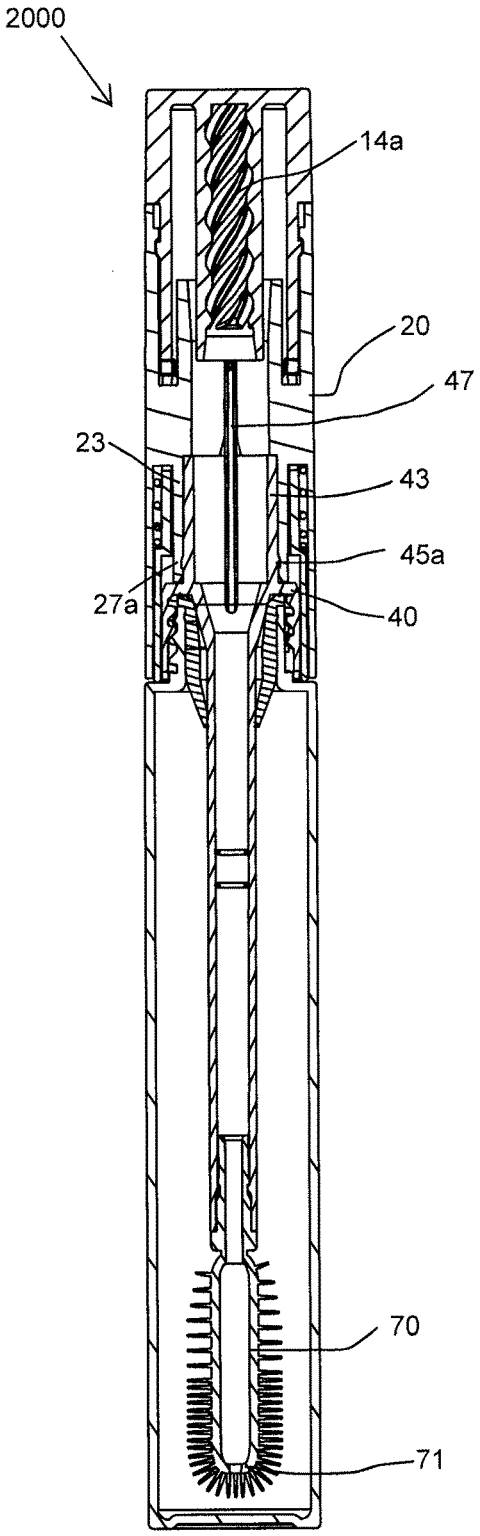
FIG. 11 illustrates cosmetic package of FIG. 10 with hidden inner rod.

FIGS. 10 and 11 show a cosmetic package 2000 according to a second embodiment of the present disclosure. The cosmetic package 2000 is similar in construction to the cosmetic package 1000 except in that cosmetic package 2000 includes some obvious modification to the cosmetic package 1000. For example, for engaging the stem 40 to sleeve 20, an upper tubular portion 43 of the stem 40 is received into a portion of inner cylinder 23 and the inner surface of inner cylinder 23 has a groove 27*a* for engaging complementary protrusion 45*a* present on the outer surface of the upper tubular portion 43 of the stem 40. Further, longitudinal guide protrusions for guiding axial movement of the inner rod 50 and for preventing inner rod 50 from rotating, are not present in the inner cylinder 23 but are provided in the upper tubular portion 43 of the stem 40. Referring to FIGS. 10 and 11, the stem 40 includes longitudinal guide protrusions 47 which extend along and upward from the upper tubular portion 43. Further, the inner cylinder 23 may include slots (not shown) for receiving longitudinal guide protrusions 47.

According to an embodiment of the present disclosure, the applicator member 70 includes a bore (not shown) and an end of the inner rod is 50 connected to a distal end 71 of the application member 70 and the other end of the inner rod 50 is connected to an adjustment means 14*a*. The adjustment means 14*a* is actuated by rotation of the dialer 10 for lifting and lowering the inner rod 50.

Alternatively, the adjustment means 14*a* is actuated by rotation of the dialer 10 for rotating the inner rod 50.

The materials suitable for forming the container 200 could be polypropylene while the dialer 10, the sleeve 20, the inner rod 50, the stem 40, and locking member 30 could be formed of acrylonitrile butadiene styrene or any other suitable polymeric material. The material of inner rod 50 could be any polymeric material like nylon, TPE, PP or could be a suitable metal. The stem 40 may be formed of polyacetal or any other suitable polymeric material. The material for forming wiper 80 could be low-density polyethylene. The aforementioned materials for forming various parts of the package of the present disclosure are an example, however other suitable materials may also be used.

Depending upon the substance being used in the receptacle, a variety of sizes and shapes of the applicator can be utilized. The application member 70 may be constructed of a porous or non-porous rubber, fabric mesh, felt material, foamed polymers, sponge material, Hytrel™, TPE or any other suitable material. Also, the application member 70 could have any suitable shape depending on the kind of application required. It could have a shape other than cylindrical such as ovular, tapered or any other suitable shape.

Although the above description and drawings show the package being cylindrical, the shapes and profile cross section thereof are not limited to the same.

While the foregoing is directed to embodiments of the present disclosure, other and further embodiments of the disclosure may be devised without departing from the basic scope thereof, and the scope thereof is determined by the claims that follow.

What is claimed is:

1. A cosmetic package comprising:

a container;

an applicator comprising a stem, a cap and an application member;

wherein the application member is at a distal end of the stem and the cap is at a proximal end of the stem;

wherein the cap comprises a dialer and a sleeve connected to the dialer;

wherein the dialer is capable of assuming a locked configuration and an unlocked configuration;

wherein when the applicator is disengaged from the container, the dialer assumes the unlocked configuration in which the dialer is rotatable with respect to the sleeve;

wherein when the applicator is engaged with the container, the dialer assumes the locked configuration in which the dialer is not rotatable with respect to the sleeve;

wherein a locking member is housed within the sleeve and is configured to be detachably connected to the dialer; and wherein the locking member engages and disengages with the dialer to respectively lock and unlock rotation of the dialer in respective the locked and the unlocked configuration.

2. A cosmetic package according to claim 1, wherein the stem includes an elongated hollow shaft which is disposed around at least a portion of an inner rod.

3. A cosmetic package according to claim 2, wherein, the inner rod has a first end attached to the application member and a second end attached to the dialer.

4. A cosmetic package according to claim 3, wherein when the dialer is rotated the inner rod is either lifted or lowered for transforming the profile of the application member.

5. A cosmetic package according to claim 3, wherein when the dialer is rotated the inner rod is rotated for transforming the profile of the application member.

6. A cosmetic package according to claim 1, wherein the locking member has a barrel body having teeth defined on a top peripheral edge of the barrel body.

7. A cosmetic package according to claim 1, wherein the sleeve comprises an inner cylinder, an outer cylinder and linking ribs that connect an outer surface of the inner cylinder to inner surface of the outer cylinder.

8. A cosmetic package according to claim 6, wherein the locking member is slidably housed in the cap in a space defined between the sleeve and the stem.

9. A cosmetic package according to claim 8, wherein the locking member includes longitudinal cut outs so that a top part of the barrel body of the locking member is able to slide through hollow spaces of the sleeve for engaging with the dialer.

10. A cosmetic package according to claim 6, wherein the cosmetic package further includes a spring that surrounds a portion of the barrel body and wherein the spring urges the barrel body in a direction away from the dialer.

11. A cosmetic package according to claim 10, wherein when the applicator is engaged with the container, the locking member is pushed upward against a downward biasing force of the spring so that the teeth of the locking member engages with complementary teeth provided on the dialer.

12. A cosmetic package according to claim 10, wherein when the applicator is disengaged with container, the locking member is pushed downward due to biasing force of the spring and the teeth of the locking member disengages from complementary teeth provided on the dialer.

13. A cosmetic package according to claim 3, wherein the dialer comprises a tube portion, an internal annular skirt and wherein an inner surface of the internal annular skirt has mating threads capable of interacting with an outer thread of the inner rod.

14. A cosmetic package according to claim 7, wherein the inner cylinder includes longitudinal guide protrusions at its inner surface for guiding axial movement of an inner rod and for preventing the inner rod from rotating.

15. A cosmetic package according to claim 7, wherein there is provided a projecting stop on an inner surface of outer cylinder which prevents the complete or over-rotation of the dialer.

16. A cosmetic package comprising:

a container;

a cap comprising a dialer and a sleeve connected to the dialer;

wherein the dialer is capable of assuming a locked configuration and an unlocked configuration;

wherein when the cap is unscrewed from the container, the dialer assumes the unlocked configuration in which the dialer is rotatable with respect to the sleeve;

wherein when the cap screwed on the container, the dialer assumes the locked configuration in which the dialer cannot be rotated with respect to the sleeve;

wherein a locking member is housed within the sleeve and is configured to be detachably connected to the dialer; and wherein the locking member engages and disengages with the dialer to respectively lock and unlock rotation of the dialer in respective the locked and the unlocked configuration.

17. A cosmetic package according to claim 16, wherein a spring is housed with the cap and wherein when the cap is unscrewed from the container, the locking member is pushed downward by downward biasing force of the spring for disengaging the locking member from the dialer.

18. A cosmetic package according to claim 17, wherein when the cap is engaged with container the locking member is pushed upward by the container against the downward biasing force of the spring for engaging the locking member with the dialer.

19. A cosmetic package comprising:

a container;

a cap comprising a dialer;

wherein the dialer is capable of assuming a locked configuration and an unlocked configuration;

wherein when the cap is disengaged from the container, the dialer assumes the unlocked configuration in which the dialer can be actuated;

wherein when the cap is engaged with the container, the dialer assumes the locked configuration in which the dialer cannot be actuated;

wherein a locking member is housed within the cap and is configured to be detachably connected to the dialer; and wherein the locking member engages and disengages with the dialer to respectively deactuate and actuate the dialer in respective the locked and the unlocked configuration.

20. A cosmetic package according to claim 19, wherein the dialer is actuated to cause axial and/or rotational movement of an inner rod.

* * * * *